United States Patent [19]

Foster

[11] Patent Number: 4,686,892

[45] Date of Patent: Aug. 18, 1987

[54] AUTOMATIC ENERGY SAVING VENT SYSTEM FOR AIR CONDITIONING SYSTEMS AND HEATING SYSTEMS

[76] Inventor: Bennie G. Foster, 1336 McDonnel Ave., Canton, Miss. 39046

[21] Appl. No.: 917,388

[22] Filed: Oct. 9, 1986

[51] Int. Cl.[4] ..... F24F 13/14

[52] U.S. Cl. ..... 98/107; 98/108; 98/116; 98/119; 137/512.1; 251/114

[58] Field of Search ..... 98/116, 107, 121.2, 98/108, 119; 251/114; 236/45; 137/512.1, 527.8

[56] References Cited

U.S. PATENT DOCUMENTS

| | | | |
|---|---|---|---|
| 456,520 | 7/1891 | Reese | 98/107 |
| 1,521,243 | 12/1924 | Josef | 98/116 X |
| 1,550,813 | 8/1925 | Johnson | 98/116 X |
| 1,814,477 | 7/1931 | McAllister | 251/114 X |
| 2,346,740 | 4/1944 | Field, Jr. | 236/45 |
| 2,355,412 | 8/1944 | Bird | 98/116 X |
| 3,204,548 | 9/1965 | McCabe | 98/116 X |
| 3,249,038 | 5/1966 | Johnson | 98/116 |
| 3,917,433 | 11/1975 | Tomitaka | 98/116 X |

*Primary Examiner*—William E. Tapolcai

[57] ABSTRACT

Within the vent system of an air conditioning unit or the heating system at least one flap is pivotably mounted such as to be moveable between a closed position blocking flow through the conditioned air vent, and an open position allowing conditioned air to pass through the vent and into one or more rooms to be serviced by the conditioned air. One or more stops are provided to cease pivotable movement of the flap when the open position is reached. Preferably more than one flap is utilized. Preferably gravity is utilized to bias the flap into the closed position so that when the heating or air conditioning blower is turned off the flap will return to the closed position. The flap is also moveable manually between the open and closed positions, thereby a room or rooms which are not to be heated or cooled may be blocked off from the air conditioning or heating system by the manual closing of the flap.

13 Claims, 5 Drawing Figures

AUTOMATIC ENERGY SAVING VENT SYSTEM FOR AIR CONDITIONING SYSTEMS AND HEATING SYSTEMS

BACKGROUND OF THE INVENTION

U.S. Pat. No. 3,826,179 issued July 30, 1974 discloses a damper system including a plurality of blades which are resiliently biased into closed position. This device is utilized to equalize the pressure in buildings in an area where tornadoes frequently occur. This damper system is not located generally adjacent rooms to be heated or cooled by a heating or air conditioning system. It is used to equalize external pressure from outside the building with pressure inside the building, rather than to maintain heated or cooled air within a room which has been supplied with the heated or cooled air.

SUMMARY OF THE INVENTION

Within the vent system of an air conditioning unit or a heating system at least one flap is pivotably mounted such as to be moveable between a closed position blocking flow through the conditioned air vent, and an open position allowing conditioned air to pass through the vent and into one or more rooms to be serviced by the conditioned air. One or more stops are provided to cease pivotable movement of the flap when the open position is reached. Preferably more than one flap is utilized. Preferably gravity is utilized to bias the flap into the closed position so that when the heating or air conditioning blower is turned off the flap will return to the closed position. The flap is also moveable manually between the open and closed position, whereby a room or rooms which are not be heated or cooled may be blocked off from the air conditioning or heating system by the manual closing of the flap.

THE DRAWINGS

DESCRIPTION OF PREFERRED EMBODIMENTS

Figure 1:
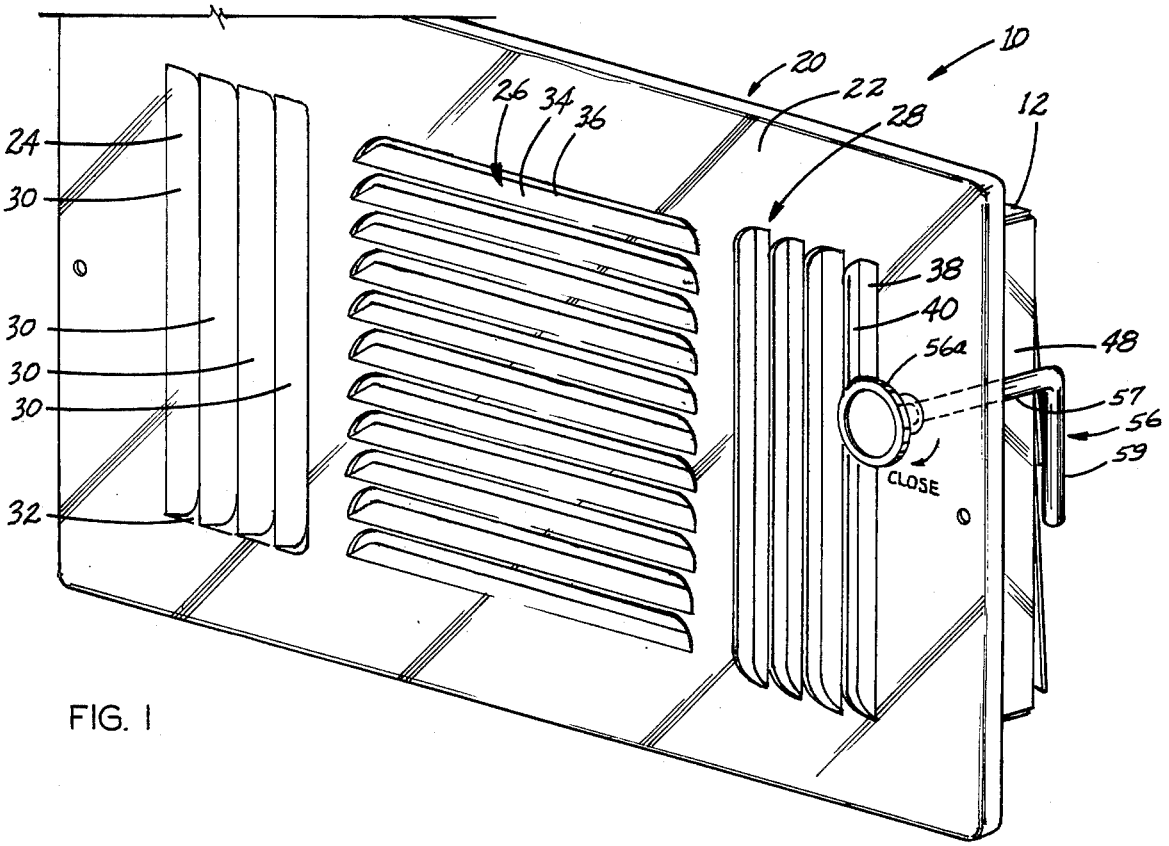
FIG. 1 is a perspective view of the front of the vent system of the present invention.

The energy saving device of the present invention is indicated in the drawings generally at 10. The device includes a flange structure 12 which is preferably generally rectangular including side walls 14 and 16 and end walls 18 and 20.

Figure 2:
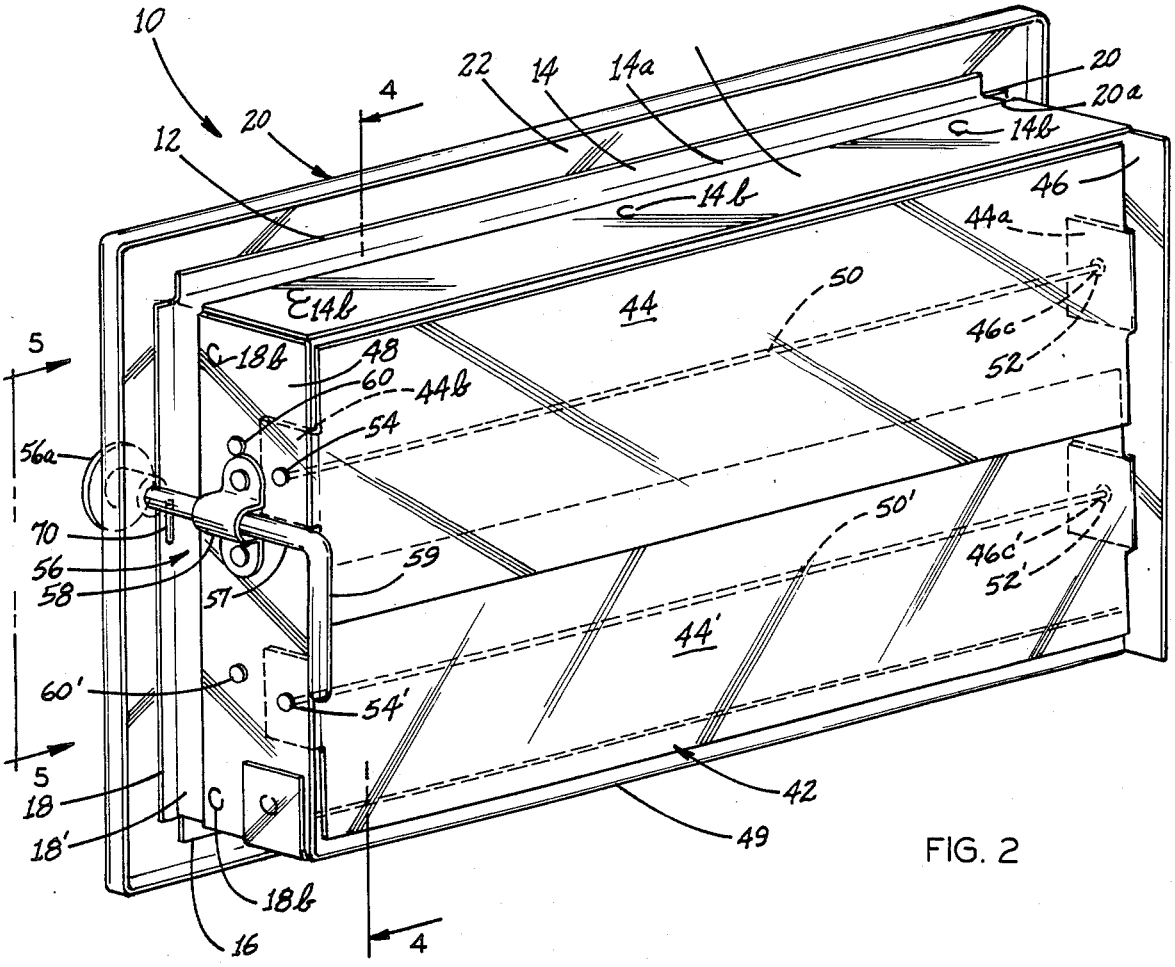
FIG. 2 is a perspective view of the rear of the vent system of the present invention.
Figure 3:
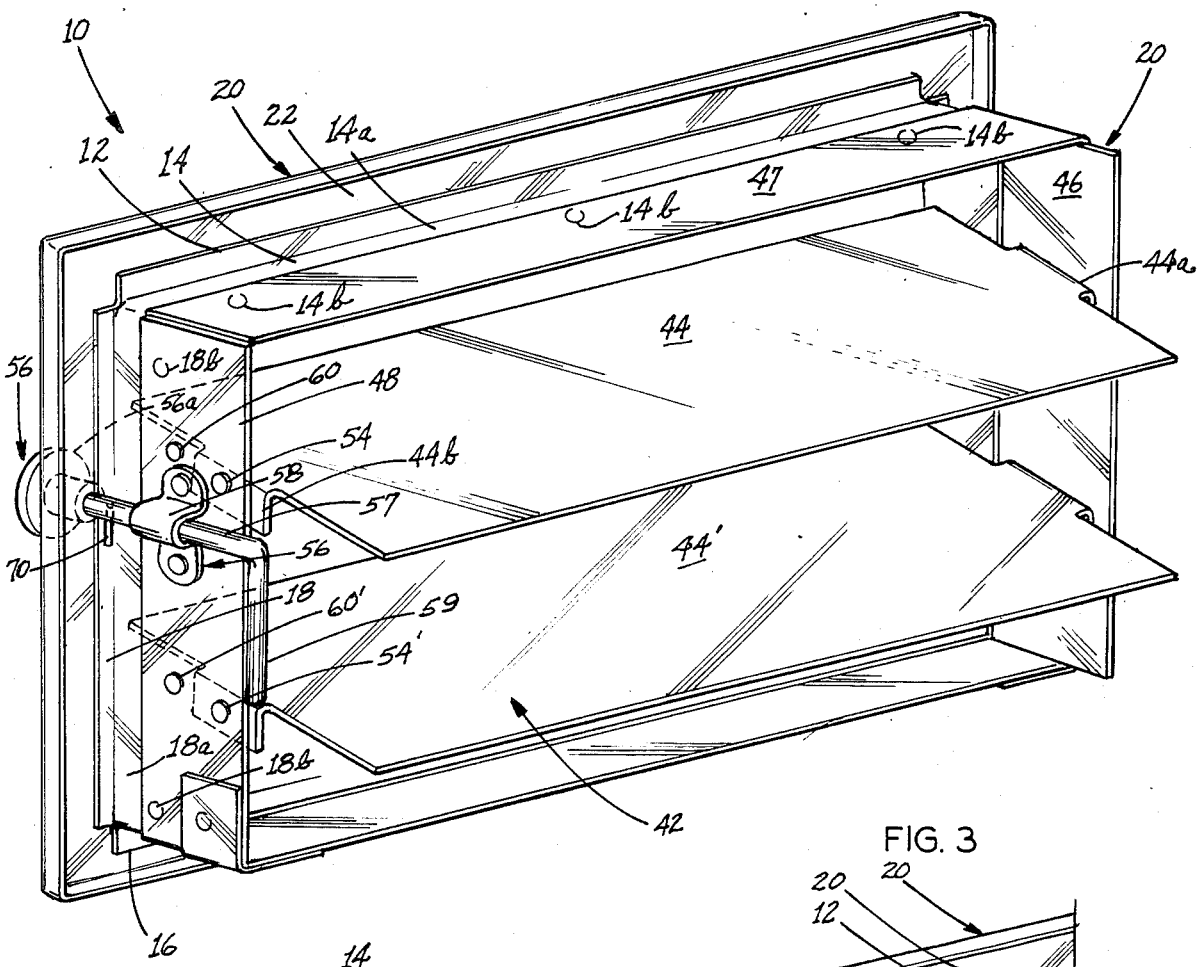
FIG. 3 is a view similar to FIG. 2 with the vent in an open position.

As indicated in FIG. 2 this frame structure is conveniently located on the opposite side of an air conditioning or heating vent indicated generally at 20. The vent 20 includes a body portion 22 conveniently of sheet metal and including a series of flutes 24, 26, and 28. Flute portion 24 includes a plurality of flutes 30 each inclined with respect to the frame body portion 22 and including openings there between 32 for conditioned air to pass through.

Similarly, flute system 26 includes a plurality of flutes 34 each inclined with respect to the body portion 22 and including openings 36 to allow the passage of conditioned air. Furthermore, the flute portion 28 includes a plurality of individual flutes 38 inclined with respect to the body portion and including spaced openings 40 to allow the passage of conditioned air there through. It is apparent that the vent 20 may comprise a conventional grill structure which is generally known in the art.

The walls 14, 16, 18, and 20 each include flange portions 14*a*, 16*a*, 18*a*, and 20*a* extending outwardly respectively from the wall portions, each of the flange portions include respective openings to receive mechanical fasteners 14*b*, 16*b*, 18*b*, and 20*b* to hold the frame portion in engagement with the conventional vent 20 as illustrated in FIG. 2.

Mounted for pivotable movement within the frame assembly 14, 16, 18, and 20 is at least one pivotable flap assembly indicated generally at 42. The flap assembly preferably is an elongated member sheet metal indicated at 44 extending generally between the walls 28 and 20 and spaced from the side walls 14 and 16. The length of the flap 44 is such that it is slightly shorter than the distance between the end walls 18 and 20, leaving clearance of sufficient amount whereby the flap may pivot back and forth without interference with the walls 18 and 20.

A convenient way of pivotably mounting the flaps 44(1) is to provide a flap wall portion 46, 47, 48, and 49 surrounding the flap. This flap portion extends parallel to the respective walls 14, 16, 18, and 20. The wall portion 46, 47, 48, and 49 extend sufficiently, however, to permit the mounting of rotatably rods 50 which extend the length of the flap 44 and 44(1) and through the flange portions 44*a* and 44*b* of the flap and through the wall portions 46 and 48. Openings 46*c*, 46*c*(1), 48*c*, and 48*c*(1) are provided to allow the rod 50 to extend there through. The size of the openings 46*c* and 48*c* is conveniently such that the rod 50 is integrally connected to the flap 44 by interference fit wih end porion 44*a* and 44*b*. It will be apparent to those skilled in the art, however, that the rod 50 may be otherwise connected with the flap 44 so as to make an integral connection whereby the flap 44 is moveable when the rod 50 is rotating. The rod 50 extends outwardly beyond the walls 46 and 48 and is provided with end grip portions 52 and 54.

In an preferred embodiment of the invention at least one additional flap 44(1) is provided which is pivotably by means of rod 50(1). The rod 50(1) is mounted in a similar manner to rod 50. The opposite ends the shaft 50(1) extend through the wall and includes end portions 52(1) and 54(1) which may be gripped to move the flap manually between open and closed positions.

Figure 4:
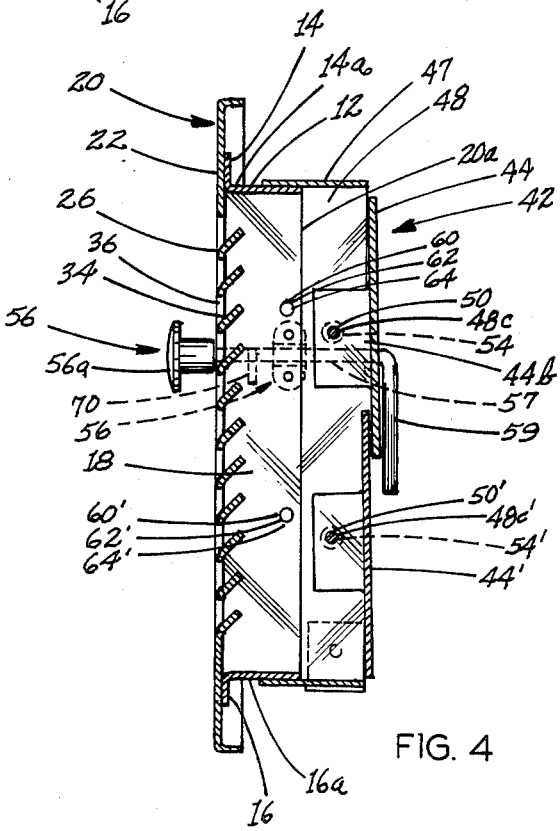
FIG. 4 is a sectional view looking in the direction of the arrows along the line 4—4 in FIG. 2.

To control the extent to which the flaps 44 and 44(1) pivot stop means indicated generally at 60 and 60(1) are provided to stop the flap 44 in open position. This may comprise a mechanical fastener 62 and 62(1) extending through an opening 64 and 64(1) in the wall 48 and extending inwardly from the wall 48 a suitable distance such that the flaps 44 and 44(1) engage the stop and prevent the flap from rotating further. As shown in FIG. 4 the stops are located toward the side wall 26 from the pivot point for the shaft 50 and also downwardly from the shaft 50 towards the flange portion 18*a*. In one embodiment the stops 62 and 62(1) are located approximately one-half inch towards the wall 16 and approximately one inch from the shaft 50 towards the flange portion 18*a*. Thus, the stop means 60(1) is effective to prevent further pivoting of the flaps 44 and 44(1) when a suitable open position has been reached.

Gravity may conveniently be used as the force which returns the flaps 44 and 44(1) to the closed position when the air conditioner blower or the heater blower (not shown) is turned off manually or automatically. When the blower is turned on the forced air pressure of one or more inches of water will pivot the flap between the closed position, blocking the opening into the frame portion 21, and an open position wherein the flaps 44 and 44(1) pivot through the action of the forced air pressure and engages the stops 62 and 62(1) in open position, allowing either heated air or conditioned air to pass though the flutes 30, 34, and 38, through the openings 32, 36, and 40 into the room to be serviced by the conditioned air.

Figure 5:
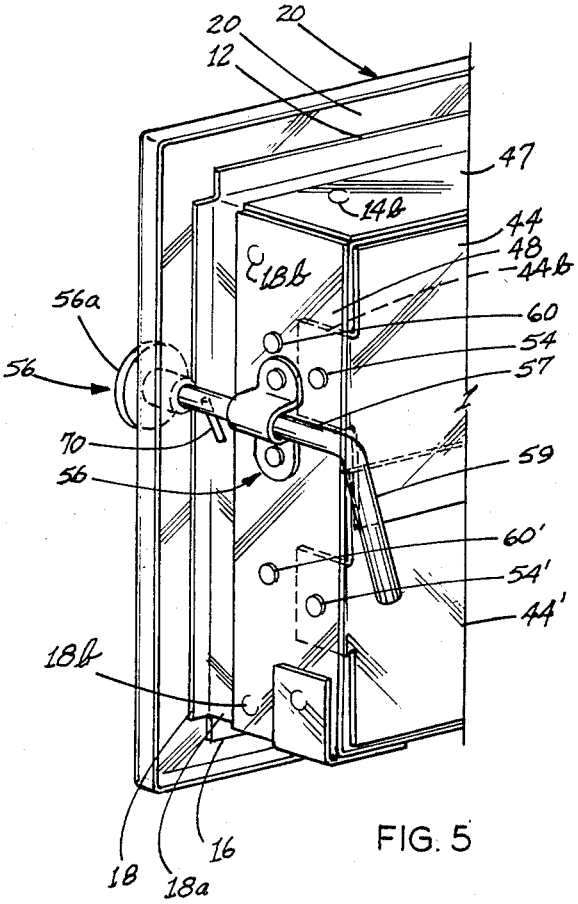
FIG. 5 is a perspective view illustrating the operating handle of the vent system of the present invention.

If it is desired to maintain the flap 44 or 44(1) in the closed position a handle 56 is provided. Means for rotating the rod 56 is provided by bracket 58. At one end a grip 56*a* and a first leg 57 are provided. The handle 56 is rotatable to a position where a second leg 59 engages the flap 44 as shown in FIG. 5. A stop 70 limits the extent of rotation of leg 59. With handle 56 located in this position the flaps 44 and 44(1) will remain in the closed position until such time as the handle is rotated back to the position shown in FIG. 4 whereby the flaps 44 and 44(1) will again be free to pivot normally between open and closed position. This is particularly useful when it is desired to cease heating or cooling a room or rooms which are not to be utilized for some time; thus, an energy savings is achieved by closing off these rooms.

In addition, the present invention is energy saving in the sense that when the blower is turned off and flaps 44 and 44(1) are in the freely pivotable position the flaps will return to the closed position automatically and prevent the escape of either heated or conditioned air from the room which is being serviced. Thus, the escape of heated and/or conditioned air is prevented and energy is saved with the present invention.

What is claimed is:

1. An air conditioning energy saving vent system comprising:

a vent member including a plurality of openings for conditioned air to enter a room or rooms to heat or cool the same;

a vent mounting frame extending into the vent member and away from the room and integrally connected to the vent member;

means for attaching to said mounting frame a flap assembly including a flap movable between a first closed position blocking the flow of conditioned air into the room or rooms and a second position allowing conditioned air to enter the rooms;

manual means for moving said flap manually between the open and closed positions whereby a room or rooms which are not to be heated or cooled may be blocked off from the air conditioning or heating system by the manual closing of the flap;

said manual means comprising a generally L shaped member which is rotatably mounted upon said frame, said L-shaped member having a distal end portion which is rotatable into a position blocking movement of said flap to open position.

2. A vent system according to claim 1 wherein one or more stops are provided to cease pivotable movement of the flap when the open position is reached.

3. A vent system according to claim 1 wherein gravity is utilized to bias the flap into the closed position so that when the heating or air conditionin blower is turned off the flap will return to the closed position automatically.

4. A system according to claim 1 wherein the flap assembly includes a flap support assembly, at least a portion of which said flap engages said flap first in closed position, and wherein the flap assembly also engages said mounting frame.

5. A system according to claim 1 wherein mechanical fasteners hold said flap assembly in engagement with said vent mounting frame.

6. A system according to claim 1 wherein more than one flap is provided which is movable between said first closed position and said second position.

7. A vent system according to claim 5 wherein said flap assembly is generally rectangular and wherein said vent frame is generally rectangular and mechanical fasteners hold said members in engagement.

8. A system according to claim 1 wherein the L-shaped member comprises a handle having a first portion extending parallel to said mounting frame and a second portion extending parallel to said flap which engages said flap and maintains said flap in closed position.

9. A system according to claim 6 wherein a least one of said flaps includes a rod extending transversely of the vent and parallel to said flap and wherein said rod is integral with said flap, and wherein said rod extends outwardly of said flap support assembly and includes means for moving at least one end portion of the flap.

10. A system according to claim 9 wherein said flap includes extensions at opposite sides of the flap extending perpendicular to a body portion of the flap which said rod engages at opposite sides of the flap.

11. A system according to claim 1 wherein stop means are provided to control the extent to which the flap rotates in open position.

12. A system according to claim 11 wherein second stop means are provided which said L-shaped member engages when said L-shaped member is holding said flap in closed position.

13. A system according to claim 12 wherein said second stop means are located on said handle and on a wall portion of said frame and wherein said second stop means engage when said handle engage said flap to hold it in closed position.

* * * * *